US009883736B2

(12) United States Patent
Dashti

(10) Patent No.: US 9,883,736 B2
(45) Date of Patent: Feb. 6, 2018

(54) PORTABLE DEPLOYABLE TABLE

(71) Applicant: Jamal Dashti, Lynnwood, WA (US)

(72) Inventor: Jamal Dashti, Lynnwood, WA (US)

( * ) Notice: Subject to any disclaimer, the term of this patent is extended or adjusted under 35 U.S.C. 154(b) by 0 days.

(21) Appl. No.: 15/232,436

(22) Filed: Aug. 9, 2016

(65) Prior Publication Data

US 2017/0164729 A1 Jun. 15, 2017

Related U.S. Application Data

(60) Provisional application No. 62/265,846, filed on Dec. 10, 2015.

(51) Int. Cl.

| | |
|---|---|
| ***A47B 9/00*** | (2006.01) |
| ***A47B 3/10*** | (2006.01) |
| ***A47B 5/02*** | (2006.01) |
| ***A47B 5/04*** | (2006.01) |
| ***A47B 9/10*** | (2006.01) |
| ***A47B 9/20*** | (2006.01) |
| ***A47B 9/14*** | (2006.01) |

(52) U.S. Cl.

CPC ..... *A47B 3/10* (2013.01); *A47B 5/02* (2013.01); *A47B 5/04* (2013.01); *A47B 9/10* (2013.01); *A47B 9/14* (2013.01); *A47B 9/20* (2013.01)

(58) Field of Classification Search

CPC ..... A47C 7/70; B64D 11/0638; A47B 5/006; A47B 5/04; A47B 3/00

USPC ..... 312/240, 241, 306, 312, 245, 246; 108/33, 14, 147.19, 42, 147, 144.11, 39

See application file for complete search history.

(56) References Cited

U.S. PATENT DOCUMENTS 688,864 A * 12/1901 Watson ..... A61M 16/16 128/203.22
1,429,456 A * 9/1922 Richmond ..... A47B 43/04 182/151
1,544,959 A * 7/1925 Wasmuth ..... A47B 5/06 108/167
2,826,879 A * 3/1958 Evans ..... A47G 21/14 451/555
3,163,292 A * 12/1964 Shelley ..... A47B 51/00 211/59.3
3,488,089 A * 1/1970 Brennan ..... A47C 7/70 297/154
3,683,825 A * 8/1972 Sheldon ..... A47B 3/00 108/176
3,695,742 A * 10/1972 Allen ..... A47B 69/00 108/14

(Continued)

FOREIGN PATENT DOCUMENTS

FR 2761586 * 10/1998

*Primary Examiner* — Janet M Wilkens

(57) ABSTRACT

A portable deployable table is a device that may be easily mounted to and removed from a surface or structure. The device includes a housing with at least one telescopic arm fixed within the housing. A table frame and a planar table top are hingedly connected to the at least one telescopic arm and may be deployed after being extended from within the housing. The table frame and the planar table top are contained within the housing when the device is not in use. At least one adjustable mounting brace is connected to the exterior of the housing, allowing the housing to be mounted to a surface or structure and fixed in place. The housing may be closed via a housing lid that covers the interior of the housing.

15 Claims, 13 Drawing Sheets

(56) References Cited

U.S. PATENT DOCUMENTS

| | | | | | |
|---|---|---|---|---|---|
| 4,803,930 | A * | 2/1989 | Crocoli | A47B 5/06 | 108/117 |
| 5,425,545 | A * | 6/1995 | McCusker | B62B 3/02 | 280/30 |
| 6,520,091 | B1 * | 2/2003 | Dettmers | A47B 5/006 | 108/42 |
| 7,798,072 | B2 * | 9/2010 | Becker | A47C 7/70 | 108/42 |
| 8,474,384 | B2 * | 7/2013 | Sundarrao | A47B 3/00 | 108/42 |
| 8,678,523 | B2 * | 3/2014 | Carr | A47B 81/064 | 312/306 |
| 8,695,513 | B2 * | 4/2014 | Figueras Mitjans | A47B 19/08 | 108/115 |
| 2007/0227407 | A1 * | 10/2007 | Cartensen | A47B 5/006 | 108/33 |
| 2008/0164729 | A1 * | 7/2008 | Cavanaugh | A47C 7/70 | 297/162 |
| 2010/0326331 | A1 * | 12/2010 | St. Louis | B64D 11/00 | 108/44 |
| 2012/0242052 | A1 * | 9/2012 | Monroe | B62B 3/004 | 280/79.2 |
| 2015/0308615 | A1 * | 10/2015 | Neaves | A01K 1/035 | 119/61.57 |
| 2015/0323244 | A1 * | 11/2015 | Marts | F25D 25/024 | 312/408 |

* cited by examiner

SECTION A-A

PORTABLE DEPLOYABLE TABLE

The current application claims a priority to the U.S. Provisional Patent application Ser. No. 62/265,846 filed on Dec. 10, 2015.

FIELD OF THE INVENTION

The present invention relates generally to a table. More specifically, the present invention is a portable deployable table that may be easily mounted to and removed from a surface or structure.

BACKGROUND OF THE INVENTION

Portable tables are useful for a variety of applications. For example, caring for an infant, an elderly person, or a sick person is greatly facilitated through the use of a portable table that may be both quickly deployed and removed as necessary. A portable table is particularly useful when the use of a conventional table is unnecessary or impractical. In addition to feeding and eating purposes, a portable table may be utilized for reading, writing, and similar purposes.

The present invention is a portable deployable table that may be quickly mounted to and removed from a surface or structure such as a bedframe or a sofa. The present invention is secured in place in order to ensure stability of the present invention when in use. After the present invention has been mounted, the present invention may be adjusted to accommodate the user's individual space requirements.

DETAIL DESCRIPTIONS OF THE INVENTION

All illustrations of the drawings are for the purpose of describing selected versions of the present invention and are not intended to limit the scope of the present invention.

Figure 1:
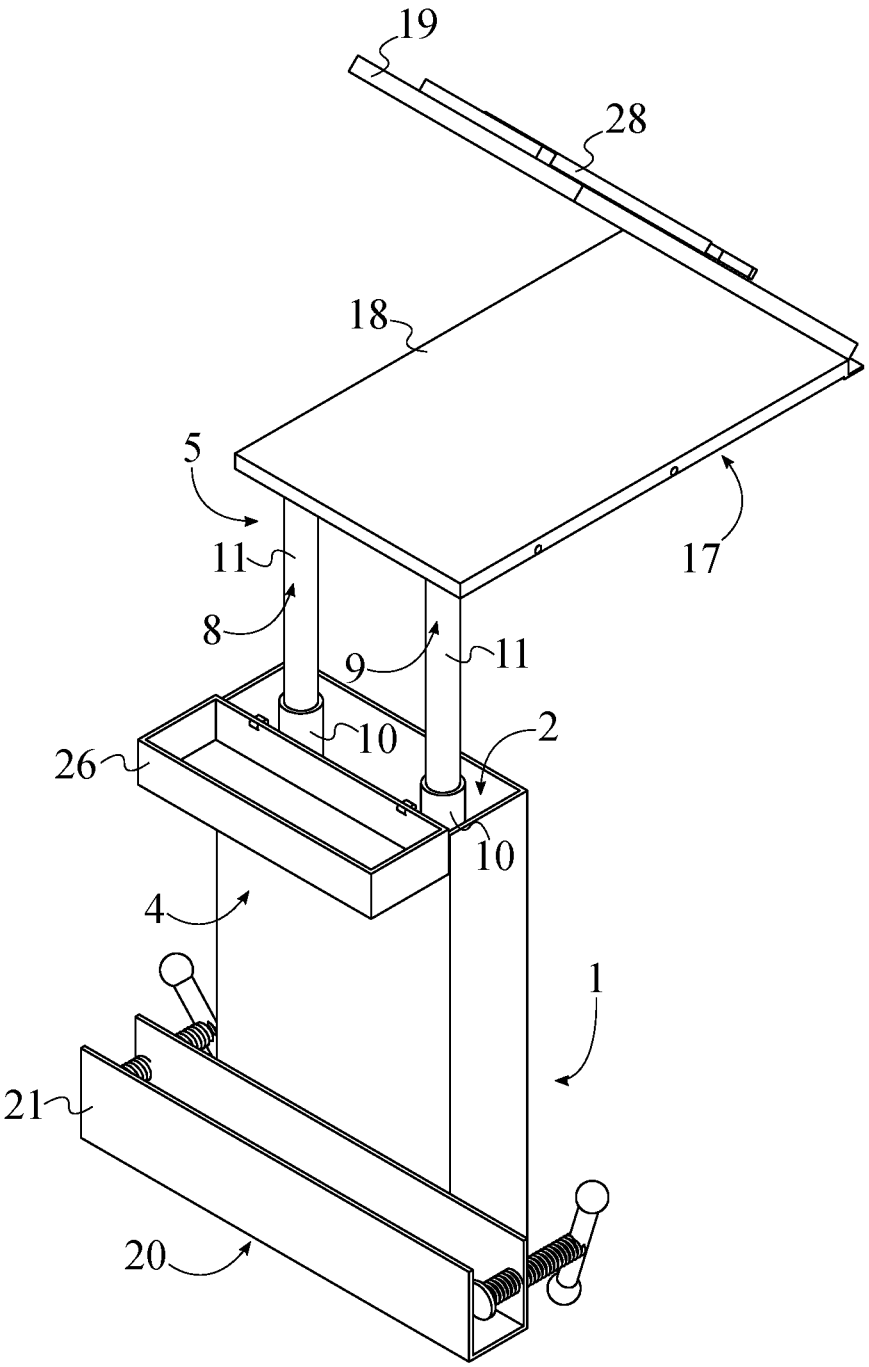
FIG. 1 is a top perspective view of the present invention.
Figure 2:
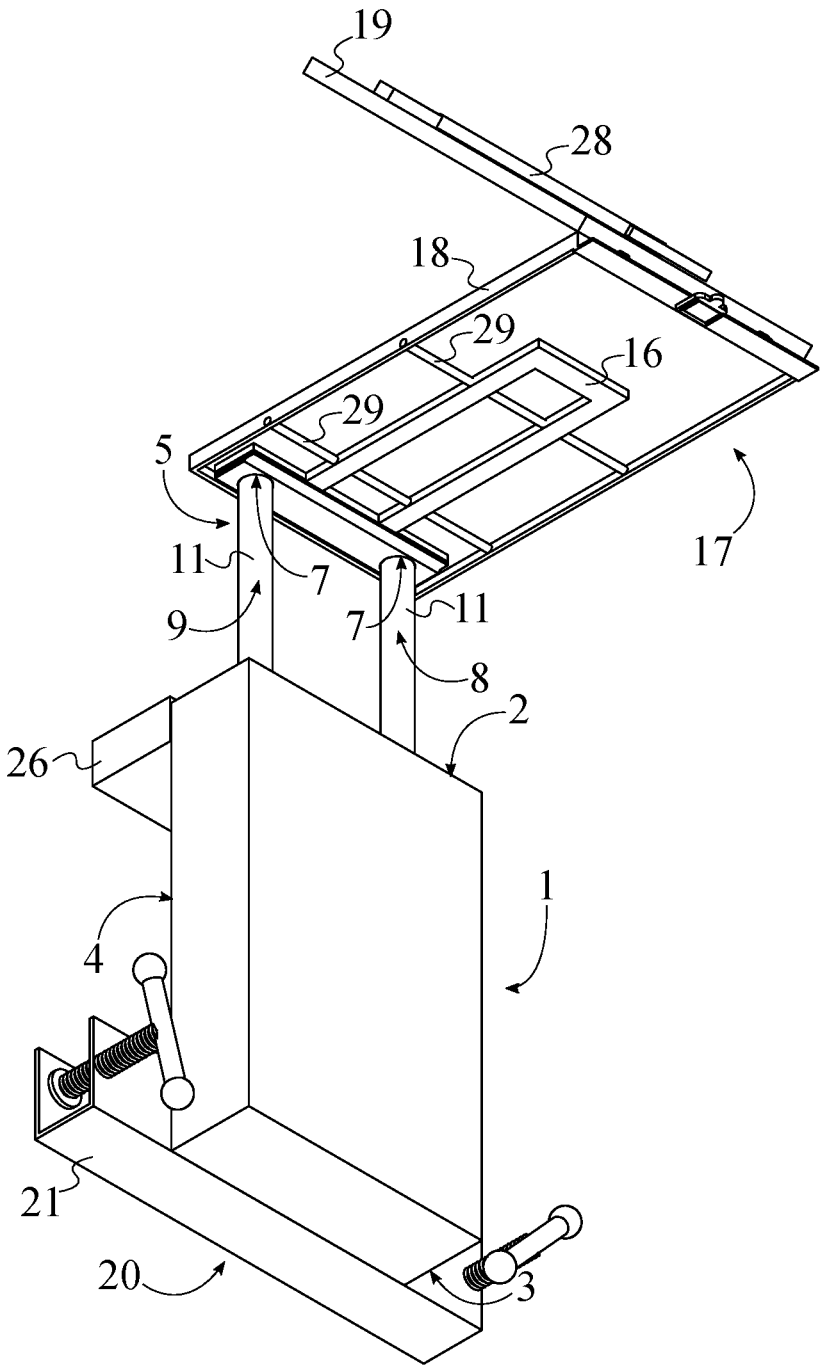
FIG. 2 is a bottom perspective view of the present invention.

The present invention is a portable deployable table that may be quickly mounted to and removed from a surface or structure. The present invention is shown in FIG. 1 and FIG. 2 and comprises a housing 1, at least one telescopic arm 5, a table frame 16, a planar table top 17, and at least one adjustable mounting brace 20.

The housing 1 is an enclosure that accommodates the at least one telescopic arm 5, the table frame 16, and the planar table top 17 when the present invention is not in use. The housing 1 comprises an open end 2, a closed end 3, and a mounting surface 4. The open end 2 is the end of the housing 1 from which the at least one telescopic arm 5, the table frame 16, and the planar table top 17 are able to extend. The closed end 3 is the end of the housing 1 onto which the at least one telescopic arm 5 is mounted within the housing 1. The mounting surface 4 is the portion of the housing 1 that is mounted to a surface or structure when the present invention is in use.

The at least one telescopic arm 5 is utilized to extend and retract the table frame 16 and the planar table top 17 as needed. The at least one telescopic arm 5 comprises a fixed end 6 and an extendable end 7. The fixed end 6 is mounted in place within the housing 1 while the extendable end 7 is able to extend and retract as needed. The fixed end 6 is internally and normally connected to the closed end 3. As such, the fixed end 6 remains in place within the housing 1 when the present invention is in use, providing stability to the at least one telescopic arm 5.

The table frame 16 provides structural stability to the planar table top 17 when the planar table top 17 is deployed. The planar table top 17 provides a flat table surface when deployed. The table frame 16 is hingedly connected to the extendable end 7, opposite to the fixed end 6. The table frame 16 and the planar table top 17 may thus be easily deployed by moving the table frame 16 about the hinged connection between the table frame 16 and the extendable end 7. The planar table top 17 is connected across the table frame 16, allowing the table frame 16 to provide structural support and stability to the planar table top 17.

In the preferred embodiment of the present invention, the planar table top 17 comprises a base panel 18 and an extendable panel 19. The base panel 18 is the main portion of the planar table top 17 while the extendable panel 19 is a secondary portion that is utilized to increase the size of the planar table top 17 as needed. The base panel 18 is hingedly connected to the extendable end 7. As such, the base panel 18 may be deployed as needed by moving the base panel 18 about the hinged connection between the base panel 18 and the extendable end 7. The extendable panel 19 is hingedly connected to the base panel 18, opposite to the extendable end 7. As a result, the extendable panel 19 may be easily deployed as needed and folded away when not in use.

In its preferred embodiment, the present invention further comprises at least one adjustment rod 29. The at least one adjustment rod 29 allows fore and aft adjustment of the planar table top 17. The at least one adjustment rod 29 is connected across the base panel 18, enabling the position of the base panel 18 to be adjusted via the at least one adjustment rod 29. The at least one adjustment rod 29 is oriented perpendicular to the table frame 16, providing fore and aft movement of the base panel 18. The at least one adjustment rod 29 is slidably engaged through the table frame 16, allowing the at least one adjustment rod 29 to be slid through the table frame 16 in order to adjust the position of the base panel 18.

The present invention may further comprise a support leg 28. The support leg 28 provides stability for the planar table top 17 when the planar table top 17 is deployed. The support leg 28 is hingedly connected to the extendable panel 19, allowing the support leg 28 to be deployed when the planar table top 17 is deployed. The support leg 28 may then be easily moved out of the way when the present invention is no longer in use.

The at least one adjustable mounting brace 20 is utilized to secure the present invention to a surface or structure. The at least one adjustable mounting brace 20 is externally connected to the mounting surface 4, enabling the mounting surface 4 to be placed into contact with the surface or structure to which the present invention is secured.

In the embodiments of the present invention shown in FIGS. 1-6, the at least one telescopic arm 5 comprises a first hydraulic cylinder 8 and a second hydraulic cylinder 9. The first hydraulic cylinder 8 and the second hydraulic cylinder 9 are utilized to extend the table frame 16 and the planar table top 17 from the housing 1. Additionally, the first hydraulic cylinder 8 and the second hydraulic cylinder 9 are utilized to retract the table frame 16 and the planar table top 17 into the housing 1. The first hydraulic cylinder 8 and the second hydraulic cylinder 9 are positioned adjacent to each other on the closed end 3. As a result, the first hydraulic cylinder 8 and the second hydraulic cylinder 9 are able to ensure that the table frame 16 is secured in place on the first hydraulic cylinder 8 and the second hydraulic cylinder 9 for stability. The first hydraulic cylinder 8 and the second hydraulic cylinder 9 are oriented parallel to each other, enabling the first hydraulic cylinder 8 and the second hydraulic cylinder 9 to remain aligned relative to each other as the table frame 16 and the planar table top 17 are extended and retracted.

The first hydraulic cylinder 8 and the second hydraulic cylinder 9 each comprise a barrel 10 and a piston 11. The barrel 10 serves as a sleeve for the piston 11 while the piston 11 is able to extend from and retract into the barrel 10. The barrel 10 is connected to the closed end 3, fixing the barrel 10 in place within the housing 1 for stability. The piston 11 is slidably engaged into the barrel 10, allowing the piston 11 to extend from and retract into the barrel 10 as needed. The table frame 16 is hingedly connected to the piston 11. As such, the table frame 16 and the connected planar table top 17 are able to extend from the housing 1 and be deployed as needed.

Figure 7:
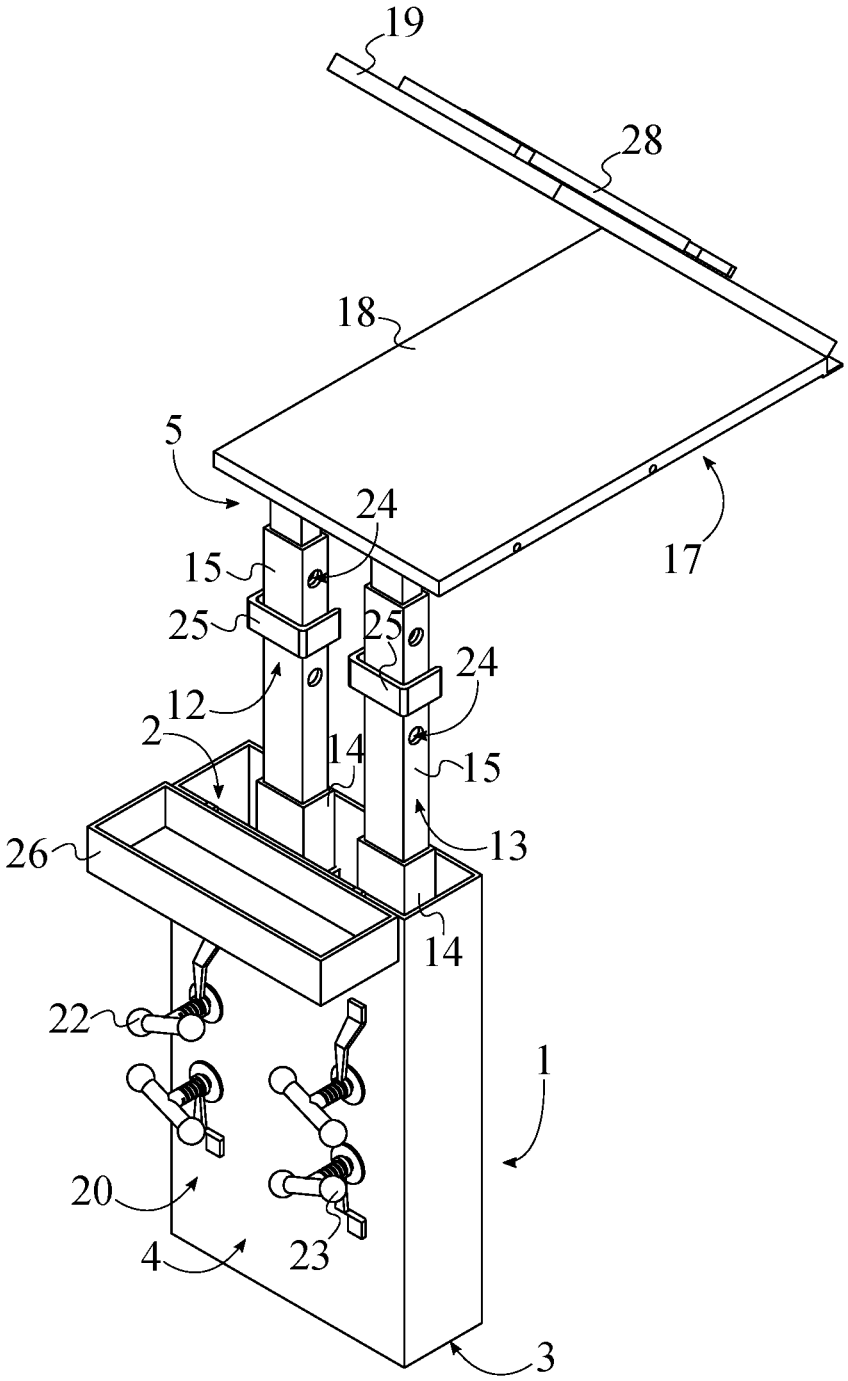
FIG. 7 is a top perspective view of an alternative embodiment of the present invention.
Figure 8:
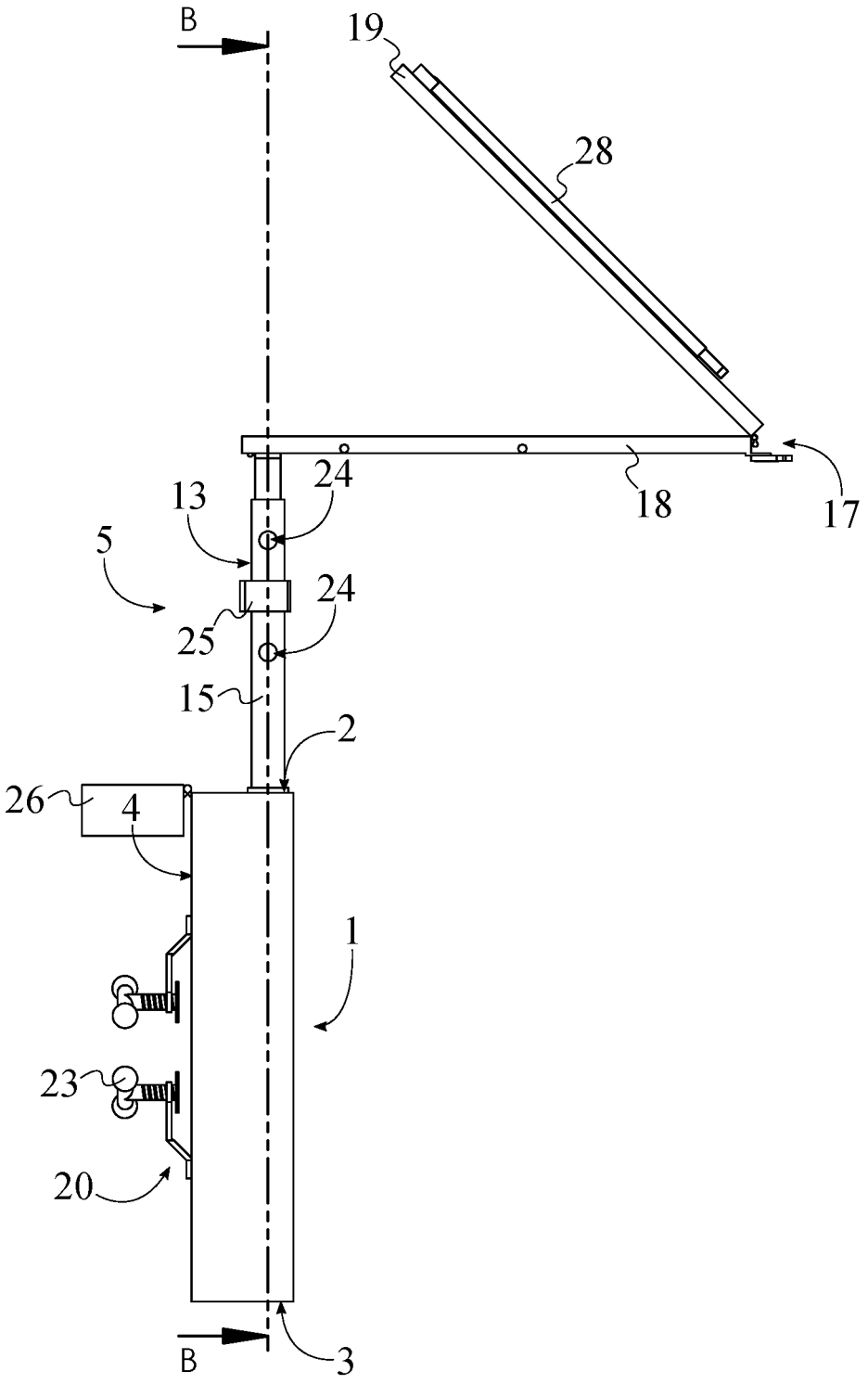
FIG. 8 is a side view of the alternative embodiment of the present invention from FIG. 7.
Figure 9:
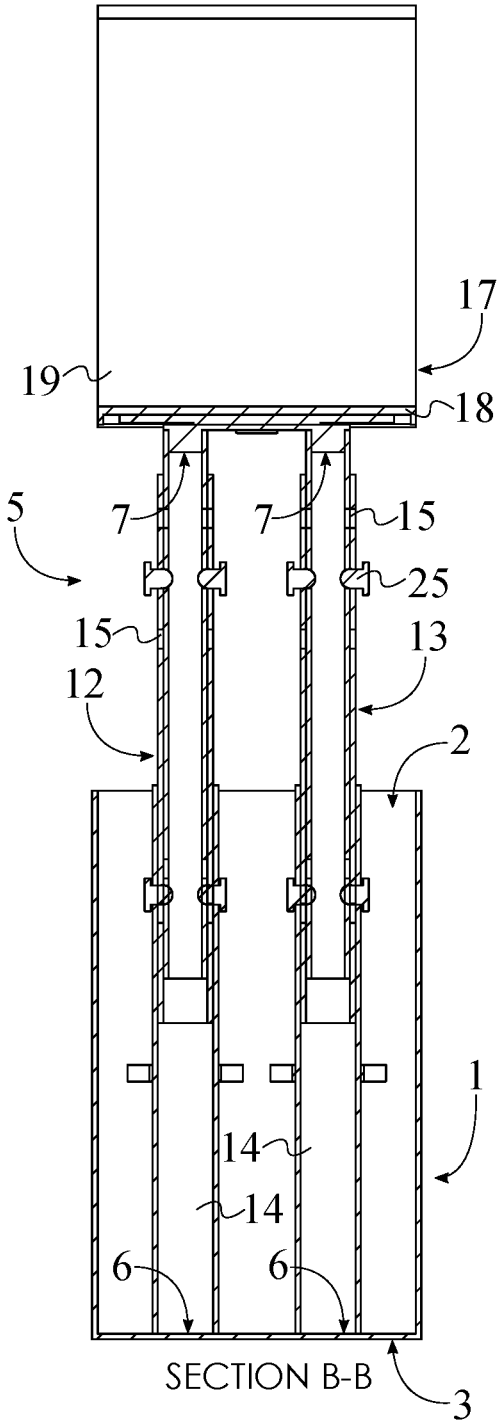
FIG. 9 is a cross-sectional view of the present invention taken along line B-B of FIG. 8.

In the embodiment of the present invention shown in FIGS. 7-9, the at least one telescopic arm 5 comprises a first extendable tube 12 and a second extendable tube 13. The first extendable tube 12 and the second extendable tube 13 function similarly to the first hydraulic cylinder 8 and the second hydraulic cylinder 9 and allow the table frame 16 and the planar table top 17 to extend from the housing 1. The first extendable tube 12 and the second extendable tube 13 are positioned adjacent to each other on the closed end 3 and as such, the first extendable tube 12 and the second extendable tube 13 are able to secure the table frame 16 in place for stability. The first extendable tube 12 and the second extendable tube 13 are oriented parallel to each other, enabling the first extendable tube 12 and the second extendable tube 13 to remain aligned relative to each other.

The first extendable tube 12 and the second extendable tube 13 each comprise a base tube 14 and an extendable tube 15. The base tube 14 is a sleeve for the extendable tube 15 while the extendable tube 15 is able to extend from and retract into the base tube 14. The base tube 14 is connected to the closed end 3, fixing the base tube 14 in place within the housing 1 for stability. The extendable tube 15 is slidably engaged into the base tube 14, enabling the extendable tube 15 to be extended from and retracted into the base tube 14 as needed. The table frame 16 is hingedly connected to the extendable tube 15. The table frame 16 and the planar table top 17 may thus be extended from the housing 1 and deployed as needed.

In the embodiment of the present invention shown in FIGS. 7-9, the present invention may further comprise a plurality of adjustment holes 24 and at least one fastener 25 for use in fixing the length of the at least one telescopic arm 5 in place after the table frame 16 and the planar table top 17 have reached the desired height. The plurality of adjustment holes 24 traverses through the at least one telescopic arm 5 and to provide openings into which the at least one fastener 25 may be engaged. The at least one fastener 25 is removably engaged into a selected hole from the plurality of adjustment holes 24, allowing the at least one fastener 25 to fix the length of the at least one telescopic arm 5. The at least one fastener 25 may be removed from the selected hole in order to adjust the length of the at least one telescopic arm 5.

Figure 3:
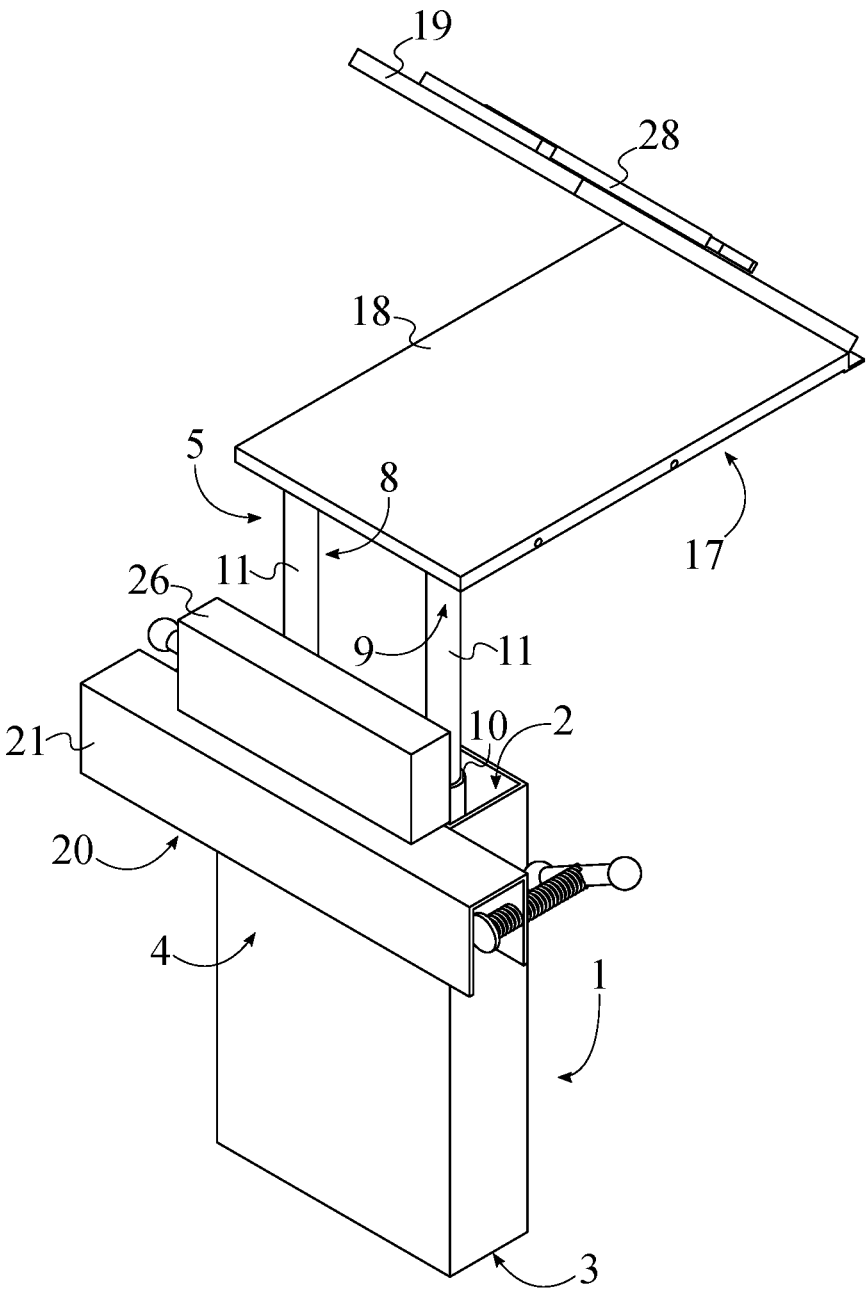
FIG. 3 is a top perspective view of an alternative embodiment of the present invention.
Figure 4:
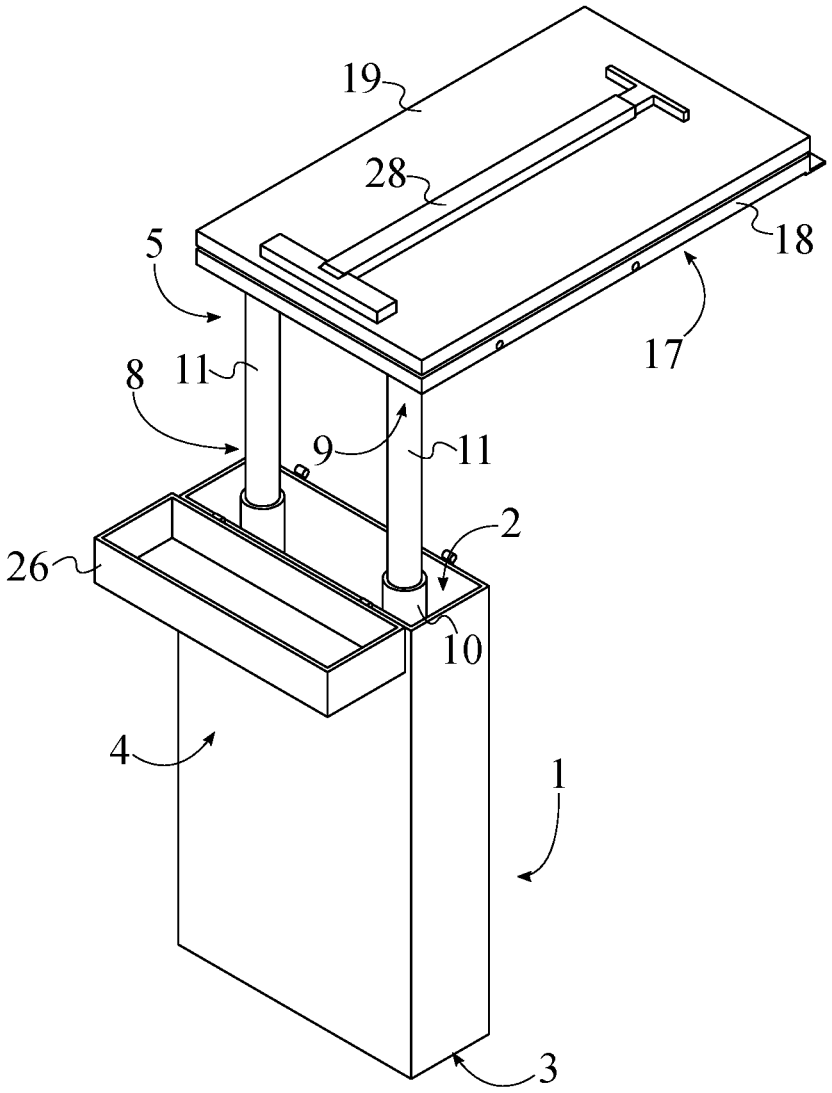
FIG. 4 is a top perspective view of the present invention with the planar table top folded.
Figure 5:
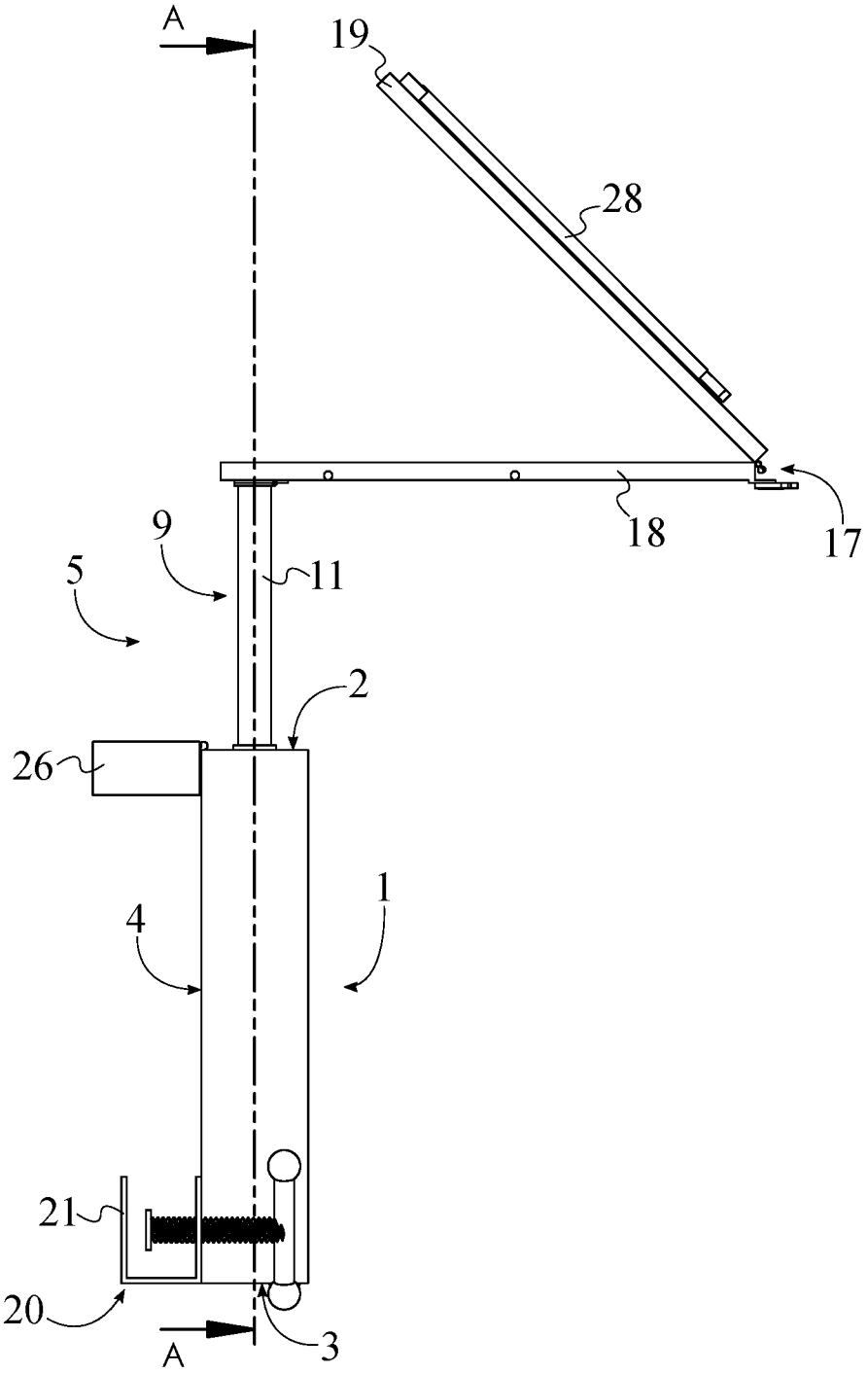
FIG. 5 is a side view of the present invention.
Figure 6:
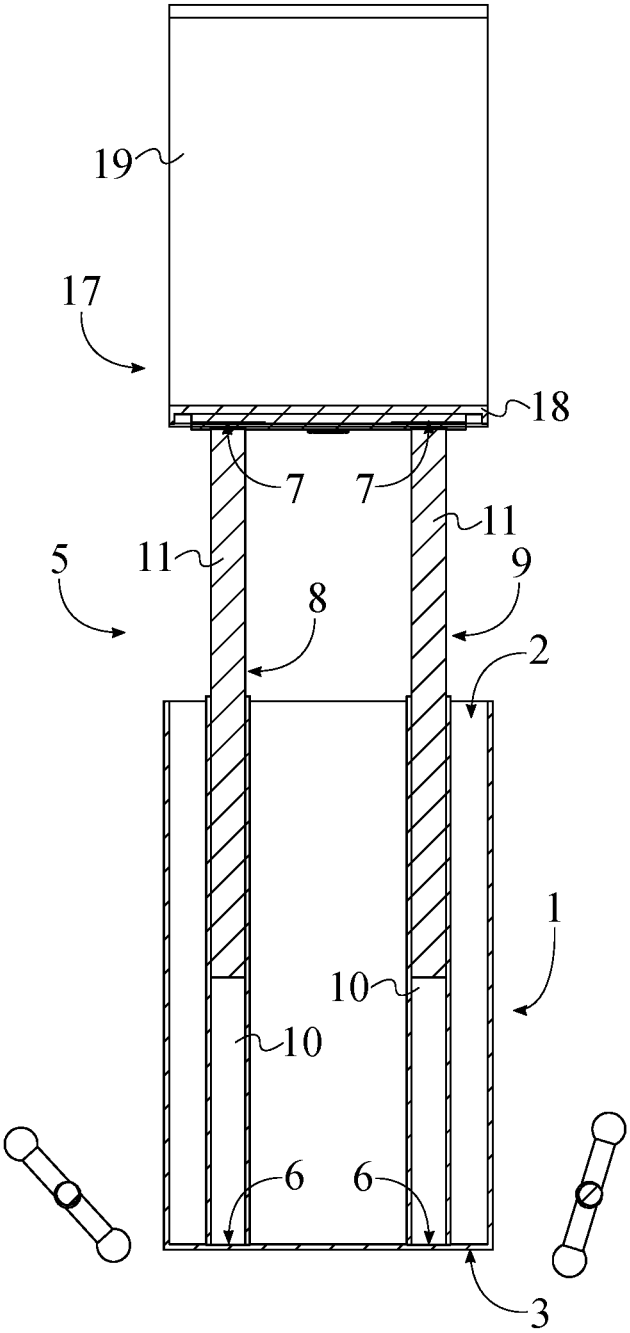
FIG. 6 is a cross-sectional view of the present invention taken along line A-A of FIG. 5.

In the embodiments of the present invention shown in FIGS. 1-3, the at least one adjustable mounting brace 20 comprises a U-shaped channel 21. The U-shaped channel 21 is utilized to mount the present invention to a piece of furniture such as a sofa. In the embodiment of the present invention shown in FIG. 1 and FIG. 2, the U-shaped channel 21 is connected across the mounting surface 4, adjacent to the closed end 3. The U-shaped channel 21 is thus positioned to engage a sofa's legs or a similar structure in order to secure the present invention in place without compromising the ability to deploy the planar table top 17. In the embodiment of the present invention shown in FIG. 3, the U-shaped channel 21 is connected across the mounting surface 4, adjacent to the open end 2. This embodiment of the present invention may be mounted to a piece of furniture such as a bed frame.

In the embodiment of the present invention shown in FIGS. 7-11, the at least one adjustable mounting brace 20 comprises a first pair of braces 22 and a second pair of braces 23. The first pair of braces 22 and the second pair of braces 23 are utilized to secure the present invention to a surface or structure. The first pair of braces 22 and the second pair of braces 23 may be adjusted in order to tighten or loosen the present invention against the surface or structure. The first pair of braces 22 and the second pair of braces 23 are positioned adjacent to each other on the mounting surface 4, allowing the present invention to be securely fastened to the surface or structure.

The present invention further comprises a housing lid 26 that is utilized to close the housing 1 when the present invention is not in use. The housing lid 26 is hingedly connected across the housing 1, adjacent to the open end 2. The housing lid 26 may thus be opened and closed over the open end 2 as needed.

Figure 12:
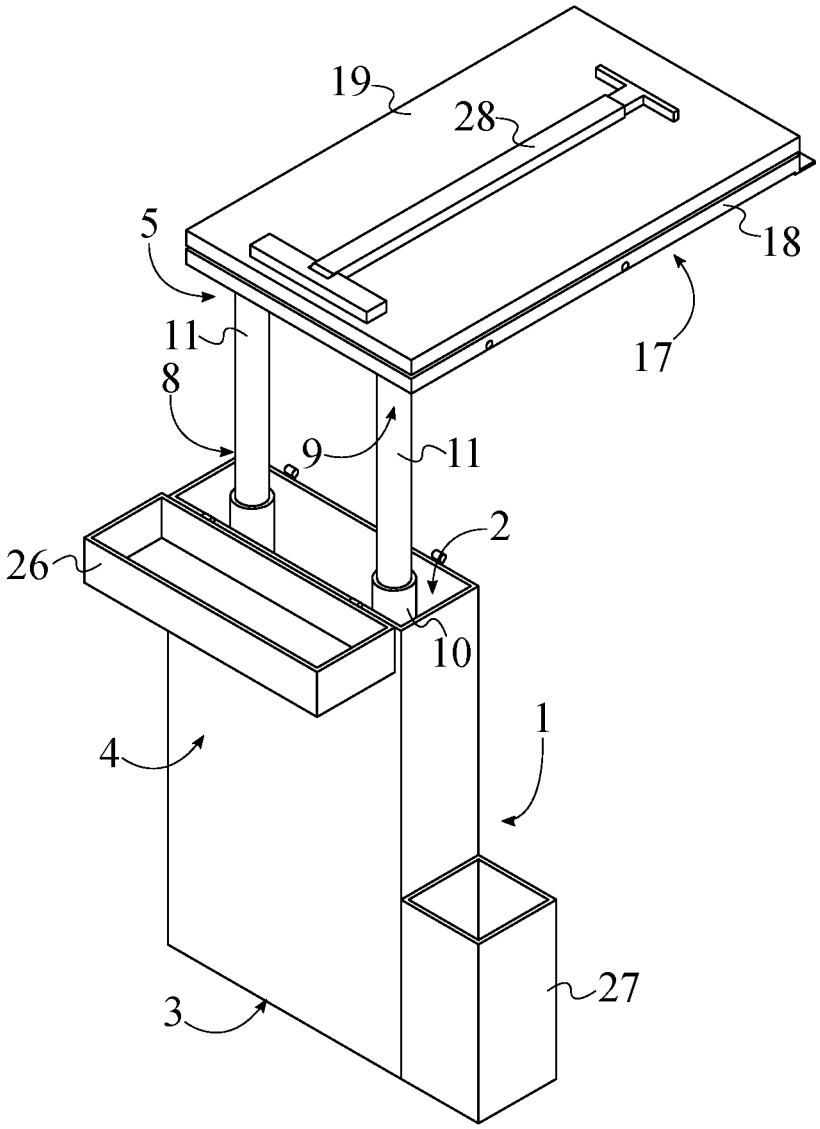
FIG. 12 is a top perspective view of the present invention with an accessory holder.

The present invention may further comprise an accessory holder 27 for holding items such as a television remote control as shown in FIG. 12. The accessory holder 27 is externally and removably mounted to the housing 1. The accessory holder 27 is thus able to hold and place accessories in a convenient and reachable position during use of the present invention.

Figure 13:
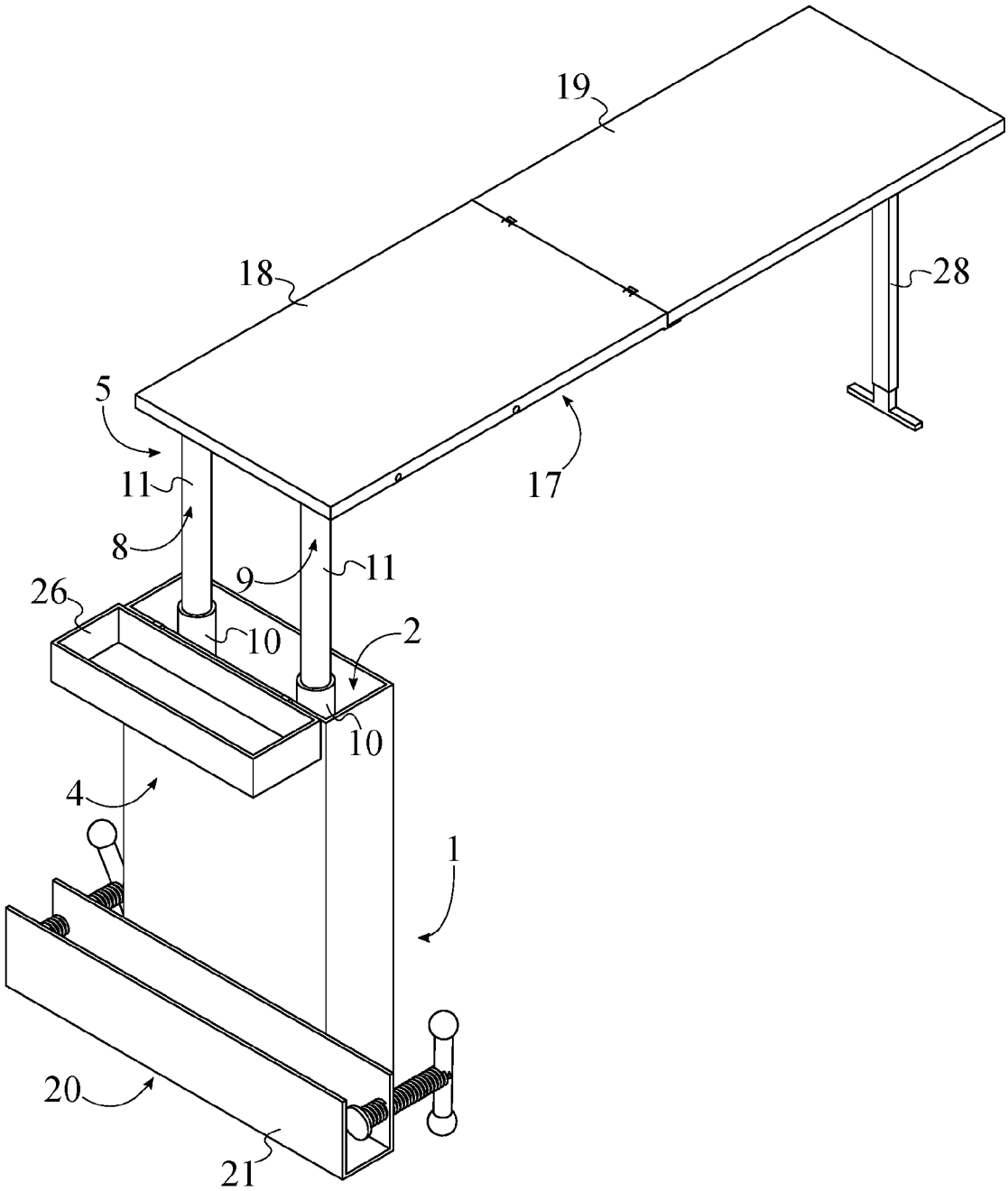
FIG. 13 is a top perspective view of the present invention in a deployed configuration.

The at least one telescopic arm 5, the table frame 16, and the planar table top 17 are shown in a deployed configuration in FIG. 13. The deployed configuration is the configuration in which the present invention is in use. The extendable end 7, the table frame 16, and the planar table top 17 are positioned external to the housing 1, allowing the planar table top 17 to be utilized as a conventional table surface. The table frame 16 and the planar table top 17 are oriented perpendicular to the at least one telescopic arm 5. As a result, the planar table top 17 is oriented in the same manner as a conventional table top. The base panel 18 and the extendable panel 19 are coplanar to each other. The extendable panel 19 is thus deployed in order to increase the size of the planar table top 17 along with the base panel 18.

Figure 10:
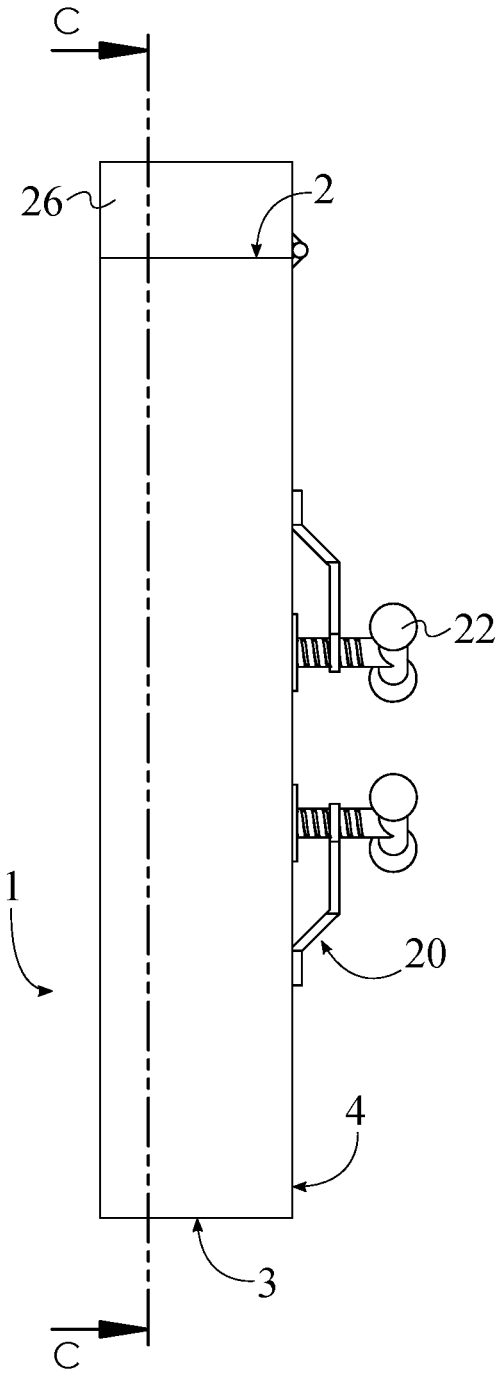
FIG. 10 is a side view of the present invention in a retracted configuration.
Figure 11:
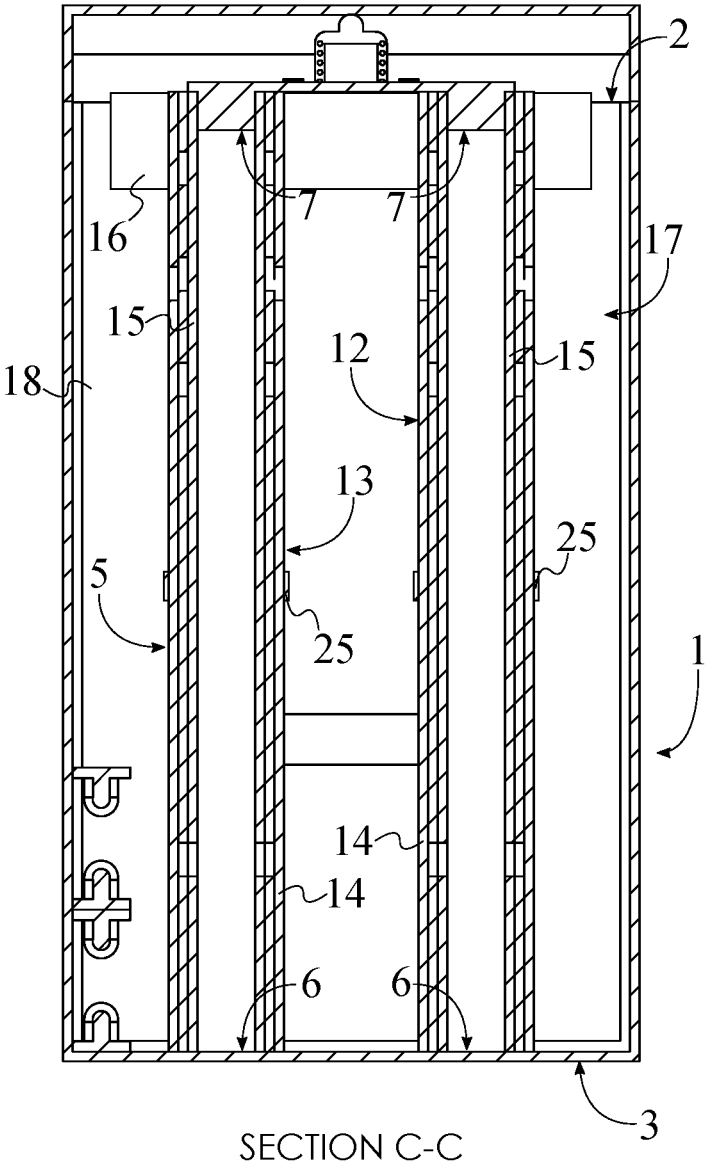
FIG. 11 is a cross-sectional view of the present invention taken along line C-C of FIG. 10.

The at least one telescopic arm 5, the table frame 16, and the planar table top 17 are shown in a retracted configuration in FIG. 10 and FIG. 11. The retracted configuration is the configuration in which the present invention is not in use. The extendable end 7, the table frame 16, and the planar table top 17 are positioned within the housing 1 and are thus concealed from view within the housing 1. The table frame 16 and the planar table top 17 are oriented parallel to the at least one telescopic arm 5. The table frame 16 and the attached planar table top 17 are thus folded from the deployed position into a more compact configuration. The extendable panel 19 is layered upon the base panel 18 and as such, the planar table top 17 is in a folded and compact configuration.

Although the present invention has been explained in relation to its preferred embodiment, it is understood that many other possible modifications and variations can be made without departing from the spirit and scope of the present invention as hereinafter claimed.

What is claimed is:

1. A portable deployable table comprises:
a housing;
at least one telescopic arm;
a table frame;
a planar table top;
at least one adjustable mounting brace;
the housing comprises an open end, a closed end, and a mounting surface;
the at least one telescopic arm comprises a fixed end and an extendable end;
the fixed end being internally and normally connected to the closed end;
the table frame being hingedly connected to the extendable end, opposite to the fixed end;
the planar table top being connected across the table frame;
the at least one adjustable mounting brace being externally connected to the mounting surface;
the planar table top comprises a base panel and an extendable panel;
the base panel being hingedly connected to the extendable end;
the extendable panel being hingedly connected to the base panel, opposite to the extendable end;
at least one adjustment rod;
the at least one adjustment rod being connected across the base panel;
the at least one adjustment rod being oriented perpendicular to the table frame; and
the at least one adjustment rod being slidably engaged through the table frame.

2. The portable deployable table as claimed in claim 1 further comprises:
the at least one telescopic arm comprises a first hydraulic cylinder and a second hydraulic cylinder;
the first hydraulic cylinder and the second hydraulic cylinder being positioned adjacent to each other on the closed end; and
the first hydraulic cylinder and the second hydraulic cylinder being oriented parallel to each other.

3. The portable deployable table as claimed in claim 2 further comprises:
the first hydraulic cylinder and the second hydraulic cylinder each comprise a barrel and a piston;
the barrel being connected to the closed end;
the piston being slidably engaged into the barrel; and
the table frame being hingedly connected to the piston.

4. The portable deployable table as claimed in claim 1 further comprises:
the at least one telescopic arm comprises a first extendable tube and a second extendable tube;
the first extendable tube and the second extendable tube being positioned adjacent to each other on the closed end; and
the first extendable tube and the second extendable tube being oriented parallel to each other.

5. The portable deployable table as claimed in claim 4 further comprises:
the first extendable tube and the second extendable tube each comprise a base tube and an extendable tube;
the base tube being connected to the closed end;
the extendable tube being slidably engaged into the base tube; and
the table frame being hingedly connected to the extendable tube.

6. The portable deployable table as claimed in claim 1 further comprises:
a plurality of adjustment holes;
at least one fastener;
the plurality of adjustment holes traversing through the at least one telescopic arm; and
the at least one fastener being removably engaged into a selected hole from the plurality of adjustment holes.

7. The portable deployable table as claimed in claim 1 further comprises:
the at least one adjustable mounting brace comprises a U-shaped channel; and
the U-shaped channel being connected across the mounting surface, adjacent to the closed end.

8. The portable deployable table as claimed in claim 1 further comprises:
the at least one adjustable mounting brace comprises a U-shaped channel; and
the U-shaped channel being connected across the mounting surface, adjacent to the open end.

9. The portable deployable table as claimed in claim 1 further comprises:
the at least one adjustable mounting brace comprises a first pair of braces and a second pair of braces; and
the first pair of braces and the second pair of braces being positioned adjacent to each other on the mounting surface.

10. The portable deployable table as claimed in claim 1 further comprises:
a housing lid; and
the housing lid being hingedly connected across the housing, adjacent to the open end.

11. The portable deployable table as claimed in claim 1 further comprises:
an accessory holder; and
the accessory holder being externally and removably mounted to the housing.

12. The portable deployable table as claimed in claim 1 further comprises:
the base panel being slidably engaged to the table frame.

13. The portable deployable table as claimed in claim 1 further comprise:

a support leg; and the support leg being hingedly connected to the extendable panel.

14. The portable deployable table as claimed in claim 1 further comprises:

wherein the at least one telescopic arm, the table frame, and the planar table top are in a deployed configuration;

the extendable end, the table frame, and the planar table top being positioned external to the housing;

the table frame and the planar table top being oriented perpendicular to the at least one telescopic arm; and the base panel and the extendable panel being coplanar to each other.

15. The portable deployable table as claimed in claim 1 further comprises:

wherein the at least one telescopic arm, the table frame, and the planar table top are in a retracted configuration;

the extendable end, the table frame, and the planar table top being positioned within the housing;

the table frame and the planar table top being oriented parallel to the at least one telescopic arm; and the extendable panel being layered upon the base panel.

* * * * *